US006851670B2

(12) United States Patent
Todd

(10) Patent No.: US 6,851,670 B2
(45) Date of Patent: Feb. 8, 2005

(54) MEDIA TRAY FOR IMAGING APPARATUS

(75) Inventor: Douglas John Todd, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/609,305

(22) Filed: Jun. 27, 2003

(65) Prior Publication Data

US 2004/0000750 A1 Jan. 1, 2004

Related U.S. Application Data

(63) Continuation of application No. 10/113,531, filed on Mar. 29, 2002, now Pat. No. 6,612,564.

(51) Int. Cl.[7] ..... B65H 1/00

(52) U.S. Cl. ..... 271/145; 271/171; 271/167; 271/162; 206/449; 206/215

(58) Field of Search ..... 271/166, 167, 271/171, 162, 145; 206/215, 449

(56) References Cited

U.S. PATENT DOCUMENTS 4,283,097 A * 8/1981 Lundblad ..... 109/52
5,228,678 A * 7/1993 Matsuda et al. ..... 271/145
5,961,113 A * 10/1999 Morris ..... 271/22
6,318,918 B1 * 11/2001 Sasaki et al. ..... 400/624

* cited by examiner

*Primary Examiner*—Donald P. Walsh
*Assistant Examiner*—Kaitlin Joerger

(57) ABSTRACT

A paper tray assembly for providing imaging media to an imaging apparatus, includes a base cassette and an insert cassette. The base cassette defines a first receptacle to receive at least a portion of the insert cassette, and the insert cassette defines a second receptacle to receive the imaging media.

17 Claims, 8 Drawing Sheets

MEDIA TRAY FOR IMAGING APPARATUS

CROSS REFERENCE TO RELATED APPLICATIONS

This application is a continuation of U.S. patent application Ser. No. 10/113,531, filed Mar. 29, 2002 now U.S. Pat. No. 6,612,564.

FIELD OF THE INVENTION

The invention claimed and disclosed herein pertains to media trays for imaging apparatus.

BACKGROUND OF THE INVENTION

Many imaging apparatus, such as printers, photocopiers, and so-called "all-in-one" apparatus (which typically combine at least the functions of a printer and a photocopier into a single apparatus) are frequently configured to receive an interchangeable imaging media tray to allow a user to use different sizes and types of imaging media in the imaging apparatus. For example, a user can have one tray sized to hold letter-sized (8.5 inches×11 inches) paper, and another tray sized to hold legal-sized (8.5 inches by 14 inches) paper. For purposes of convenience, I will use the term "paper tray" to generally refer to an imaging media tray. The term "paper tray" should not be construed to limit the imaging media to only paper, but any type of sheet media typically imaged by an imaging apparatus. Accordingly, in addition to having a tray for letter-sized paper, a user might also have a second letter-sized tray to hold plastic transparencies. A user might also have multiple trays configured to hold the same size of media, but in different weights (e.g., 20 lb paper weight and 24 lb paper weight), as well as different colors (e.g., light green to designate a particular type of document, such as an invoice).

As can be seen, a user can quickly accumulate a large number of paper trays if the user desires to have various imaging media readily available for use in the imaging apparatus. This presents some problems. Firstly, there is the problem of storing all of the different trays. Since the paper trays typically occupy a larger footprint than the size of the imaging media contained in the tray, space requirements for storing the trays can be significant. This is compounded by the fact that often times the paper trays for a given imaging apparatus are sized to be received within an opening in the imaging apparatus, and the opening is sized (length-wise and width-wise) to receive a tray holding the largest size of imaging media that the trays can accommodate. Accordingly, the trays can have a footprint that is significantly larger than the size of the media in the tray. For example, if an imaging apparatus is configured to receive a papers tray that will hold paper up to legal size, then the paper tray can easily be 10 inches wide, and 15 inches long. However, if the user elects to put No. 10 envelopes (4.125 inches by 9.5 inches) in the tray, then an extra 110 square inches of storage space is required beyond the 39 square inches required to actually store the envelopes.

A second problem is the cost of acquiring a large number of paper trays. Since paper trays are frequently provided with locking devices to secure them within the imaging apparatus, and a paper lift device to present the paper to a feed roller, the cost of a paper tray can be significant. Further, most paper trays are provided with adjustable surfaces to allow them to accommodate a variety of paper sizes. The adjustable surfaces also add cost to the paper tray. One solution to this problem is to have only one or two trays, and then to move imaging media into and out of the tray or trays as the media is needed by the user. This, of course, requires a high degree of activity on the part of the user, which is undesirable and an inefficient use of time for many businesses. Further, a storage space for the imaging media must be provided when the media is out of the tray, and preferably the media storage space is a protected space so that the imaging media does not become damaged, fade or get dusty or dirty while it is being stored.

Turning to FIG. 1, a prior art paper tray 10 is depicted in isometric view. This tray is described in U.S. Pat. No. 5,901,952 to Arjang Hourtash (and assigned to Hewlett-Packard Company). The paper tray 10 generally includes a front panel 14, a rear panel 12, side panels 16, a first bottom panel 17, and a second bottom panel 18 (which is shown in an exploded-view). The paper tray 10 further includes a first adjustable panel 20 which can be moved towards (and away from) the front panel 14 and thereby adjust the length dimension 22 for imaging media contained within the tray 10. Paper tray 10 further includes a second adjustable panel 24 which can be moved towards (and away from) the side panels 16 and thereby adjust the width dimension 26 for imaging media contained within the tray. As can be seen, the adjustable panels are supported between the bottom panels 17 and 18 to allow the adjustable panels to slide freely, yet be held in place in the paper tray. By selectively adjusting the adjustable panels 20 and 24, imaging media "M" of length "L" and width "W" can be accommodated within the tray 10. Accordingly, if a user desired to replace letter-sized paper in the tray 10 with DIN size A4 paper (approximately 8.27 inches by 11.69 inches), then both adjustable surfaces 20 and 24 will need to be adjusted.

Another prior art solution to the problem of having multiple paper trays is described in U.S. Pat. No. 5,287,164 (Watanabe), which shows a paper tray configured to receive two or more different sizes of imaging media. However, without making the tray an excessive height, the tray limits the amount of each size of imaging media that can be contained within the tray. Typically paper trays are sized to accommodate a ream (500 sheets) of paper. A tray configured to accommodate three reams of paper would need to be approximately 6–7 inches high, and, when filled with imaging media, would weigh 15 lb or more. Further, the paper tray described in U.S. Pat. No. 5,287,164 requires a complex paper feed system in the imaging apparatus to pick sheets of imaging media from the different levels.

What is needed then is a paper tray for an imaging apparatus which achieves the benefits to be derived from similar prior art devices, but which avoids the shortcomings and detriments individually associated therewith.

SUMMARY OF THE INVENTION

An embodiment in accordance with the present invention provides for a "paper tray" (imaging media tray), or paper tray assembly, for providing imaging media to an imaging apparatus. The paper tray assembly includes a base cassette and an insert cassette. The base cassette defines a first receptacle to receive at least a portion of the insert cassette, and the insert cassette defines a second receptacle to receive the imaging media. In one example the base cassette includes a first bottom panel, a lift plate, and a biasing member to bias the lift plate away from the first bottom panel. In this example the insert cassette includes a second bottom panel defining an opening therein to allow the lift plate to contact imaging media received within the insert cassette.

Another embodiment provides for a package of imaging media for use in an imaging apparatus, wherein the imaging apparatus has a base cassette to hold imaging media. The package of imaging media includes a rigid imaging media container sized to be received within the base cassette, and imaging media placed within the imaging media container. In one example the imaging media container further includes a spacer which orients the imaging media container with respect to the base cassette when the imaging media container is received within the base cassette. In this example the spacer can optionally be deployable from a first position wherein the spacer is juxtaposed to the imaging media container, to a second position wherein the spacer orients the imaging media container with respect to the base cassette.

These and other aspects and embodiments of the present invention will now be described in detail with reference to the accompanying drawings, wherein:

DETAILED DESCRIPTION OF THE INVENTION

The present invention pertains to a "paper tray" for use by an imaging apparatus, such as a printer (e.g., a laser printer or an ink-jet printer) or a photocopier. Although I will use the term "paper tray", it is understood that the tray is intended to hold imaging media, which can include paper as well as non-paper media. An example of non-paper imaging media is plastic transparencies. Although the term "imaging media tray" is a more accurate term than "paper tray", the latter term is the term commonly used in the industry, and thus will be used in the following description of the present invention.

In general, an embodiment of the present invention provides for a two-part paper tray to provide imaging media to an imaging apparatus. The paper tray includes a base cassette configured to be received by the imaging apparatus, and an insert cassette configured to contain imaging media and to be received within the base cassette. The base cassette includes the devices which are required for the paper tray to interact with the imaging device, such as a latching device to secure the tray in the imaging apparatus, and any imaging media presentation devices (e.g., a lift plate) used to present the imaging media to the imaging apparatus so that the imaging apparatus can extract a sheet of the imaging media for use in the imaging process. The insert cassette is a relatively simple cassette, and preferably includes only those components that are useful for allowing the insert cassette to cooperate with the devices that are part of the base cassette, as will be more fully described below. In this way a plurality of inexpensive insert cassettes can be used to provide a wide selection of imaging media for use in an imaging apparatus.

Figure 1:
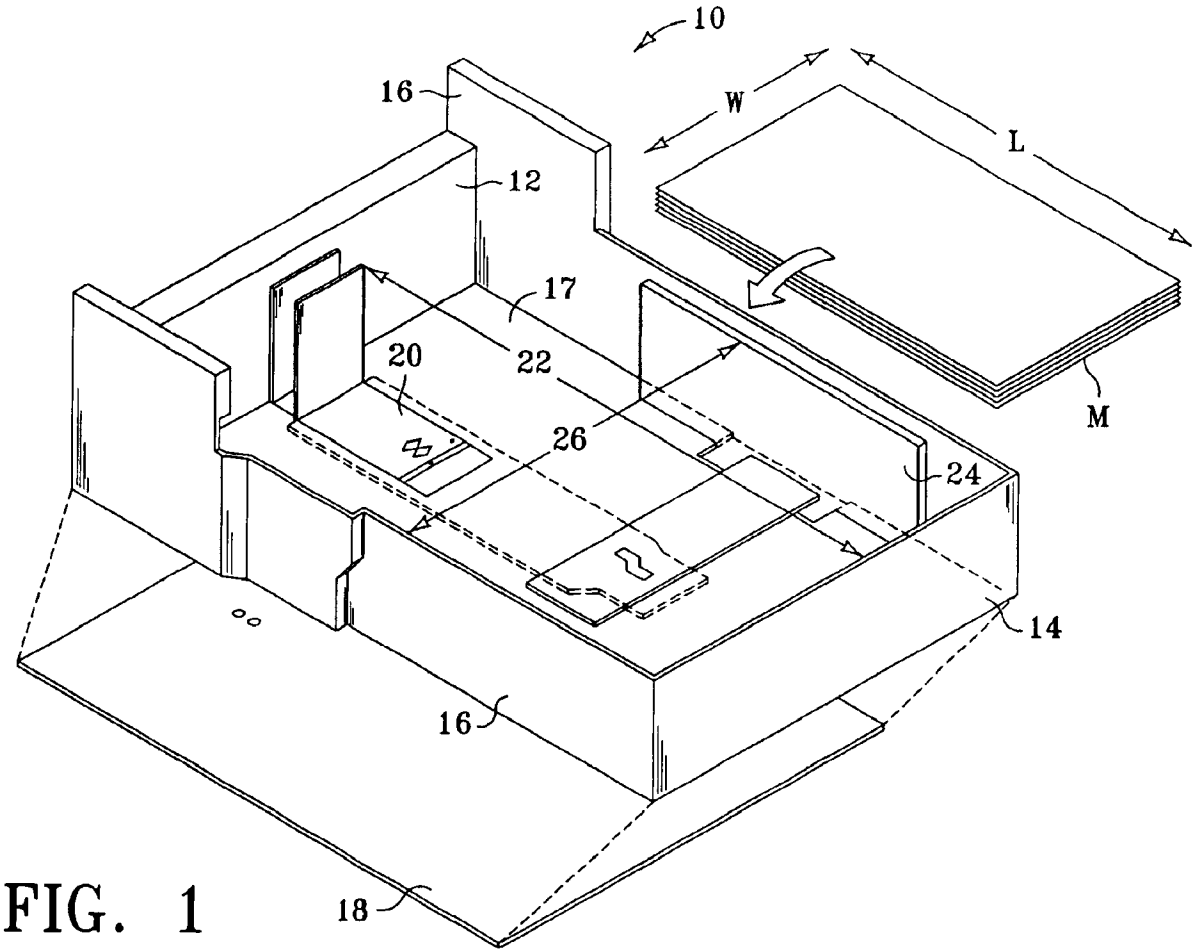
FIG. 1 (Prior Art)
FIG. 1 is an isometric view of a prior art paper tray.
Figure 2:
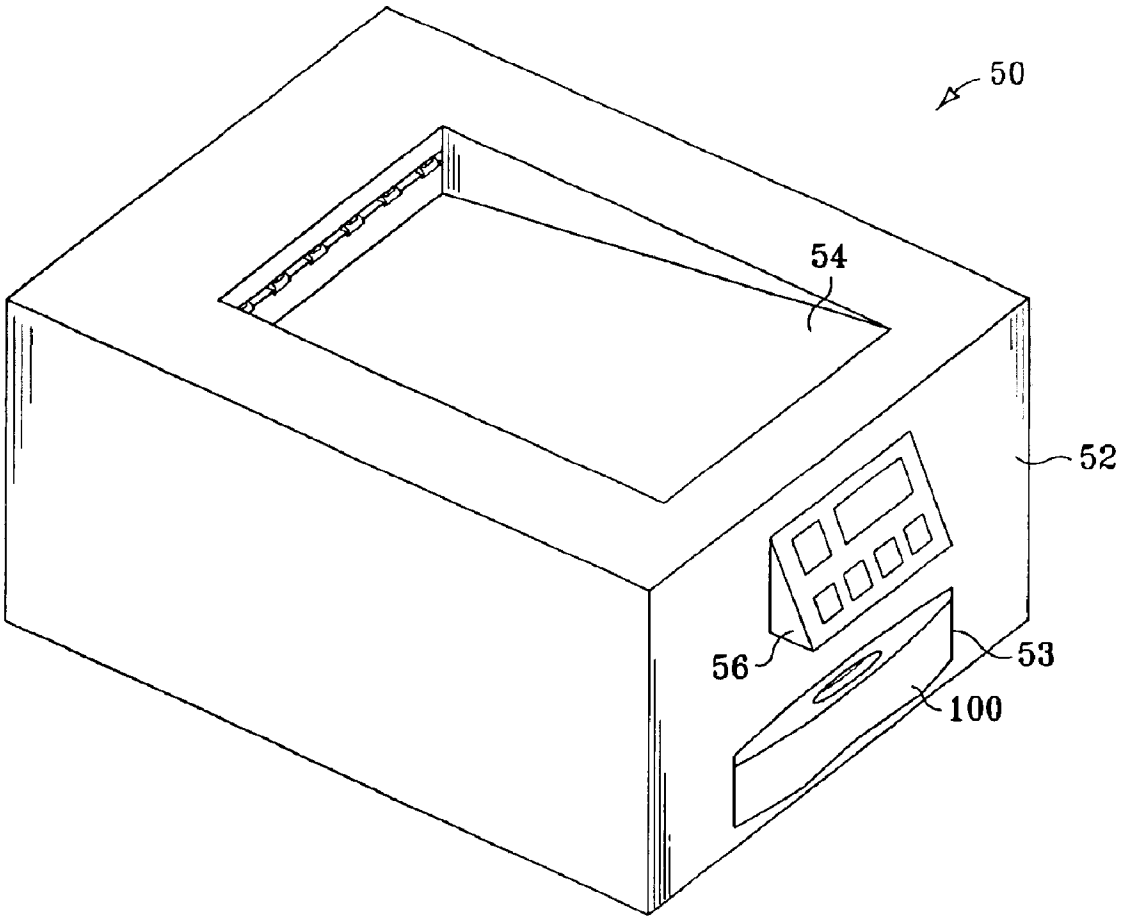
FIG. 2 is an isometric diagram depicting an imaging apparatus using a paper tray in accordance with an embodiment of the present invention.

Turning now to FIG. 2, an imaging apparatus 50 (shown here as a printer) is depicted which can use a paper tray in accordance with the present invention. The imaging apparatus 50 includes a housing 52 which defines a paper tray opening 53 in which a paper tray 100, in accordance with the present invention, can be received. Although the paper tray 100 is depicted as being fully received within the housing 52, this is not a requirement, and a portion of the paper tray 100 can protrude outside of the housing 52. The imaging apparatus 50 further includes a user interface console 56, and an output tray 54 which can receive imaged sheets of imaging media.

Figure 3:
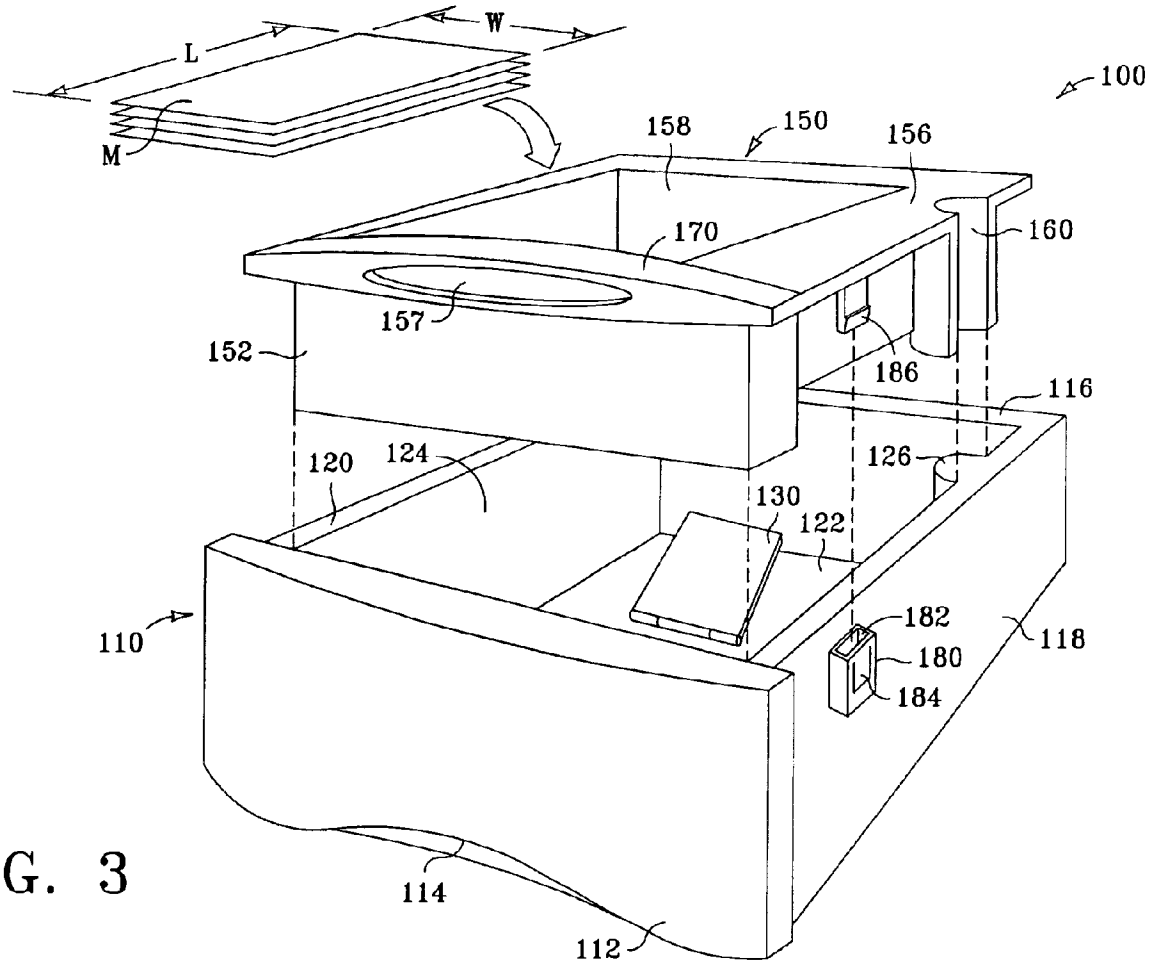
FIG. 3 is an isometric diagram depicting a paper tray assembly in accordance with one embodiment of the present invention.

Turning to FIG. 3, the paper tray 100 of FIG. 2 is depicted in an exploded view. Generally, the paper tray assembly includes a base cassette 110 and an insert cassette 150 which is configured to be received within a first receptacle (or "insert cassette receptacle") 124 which is defined in the base cassette 110. The insert cassette 150 includes an imaging media bin 152 which defines a second receptacle (or "imaging media receptacle") 158 which is configured to receive the imaging media "M". The imaging media receptacle 158 is preferably sized in length and width to accommodate the length "L" and width "W" of the imaging media "M". The base cassette 110 includes a front panel 112 (which faces outward of the imaging apparatus housing 52, as depicted in FIG. 2) having a handle 114 to facilitate removal of the paper tray assembly 100 from the imaging apparatus. The base cassette 110 further includes a back panel 116, and two side panels 118 and 120, which, along with the front panel 112, form an upper periphery which defines the receptacle 124 in which the insert cassette 150 is received. The upper periphery of the base cassette 110 can be used to support the insert cassette 150. In one variation, the base cassette 110 can further include a bottom panel 122, and the insert cassette 150 can be supported by the bottom panel 122. The base cassette 110 can further include a first keying member 126 which mates with a second keying member 160 that is part of the insert cassette 150. The keying members 126 and 160 can be used to facilitate alignment and orientation of the insert cassette 150 with respect to the base cassette 110. The insert cassette 150 can include a handle member 170 to facilitate removal of the insert cassette 150 from the base cassette 110. The insert cassette 110 can also include a top panel 156 which extends around the receptacle 158 and covers the area between the imaging media bin 152 and the receptacle 124 in the base cassette 110. The insert cassette upper panel 156 can also be used to support the insert cassette 150 on the upper periphery of the base cassette 110.

As depicted in FIG. 3, the base cassette 110 is provided with an imaging media presentation device, which is used to present imaging media in the insert cassette to a pick-roller or the like in the imaging apparatus. The media presentation device is depicted here as a lift plate 130 which is pivotaly attached to the base cassette bottom panel ("first bottom panel") 122. A biasing member, such as a spring (not shown) is positioned between the lift plate 120 and the bottom panel 122 so as to bias the lift plate 130 away from the bottom panel and in the "upward" position depicted in FIG. 3. In this case, the insert cassette 150 can include an insert cassette bottom panel (or "second bottom panel", which is not seen in FIG. 3) which is used to support imaging media within the insert cassette 150.

Figure 4:
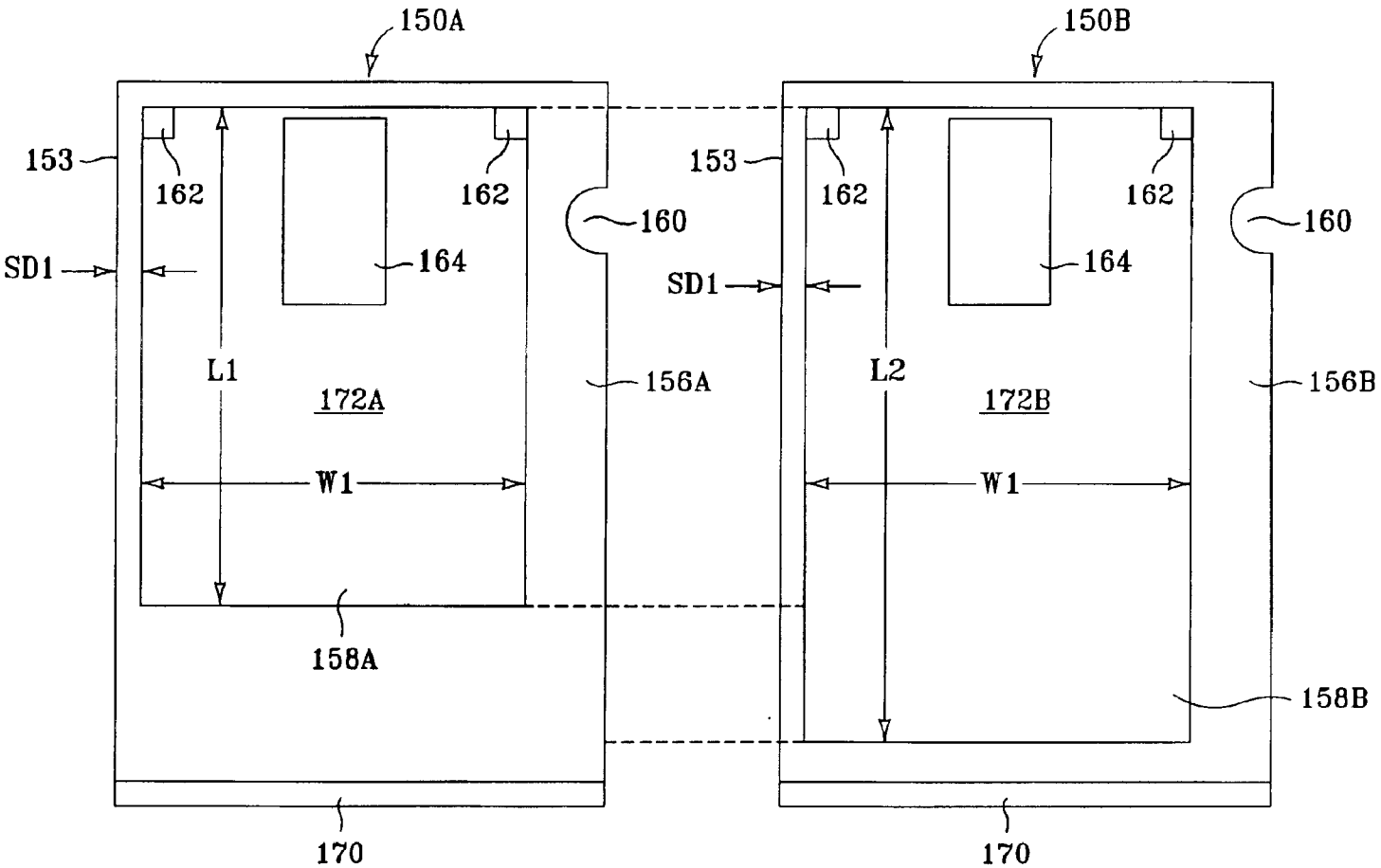
FIG. 4 depicts a plan view of two insert paper trays that can be used in the paper tray assembly of FIG. 3.

FIG. 4 depicts a plan view of two different configurations of insert cassettes 150A and 150B, having respective bottom panels 172A and 172B in. The bottom panel (172A, 172B) of the insert cassettes 150A, 150B each define an opening 164 therein, which allows the lift plate 130 (FIG. 3) to contact imaging media received within the insert cassettes (150A, 150B, FIG. 4). In this way, the imaging media presentation device can be included in the base cassette 110 (FIG. 3), and does not need to be an integral component of the insert cassette 150. The insert cassette (150A, 150B, FIG. 4) can also include one or more restraining members 162 to restrain imaging media received within the receptacle (158A, 158B) of the insert cassette from being ejected by the lift plate 130 (FIG. 3).

A locking device can also be provided to hold the insert cassette 150 in relatively fixed position with respect to the base cassette 110. As depicted in FIG. 3, the locking device includes a first locking member 180 supported on the base cassette 110, and a second locking member 186 supported on the insert cassette 150. The second locking member 186 comprises a wedge-shaped tab that is configured to be received within an opening 182 in the first locking member 180, and thereby engage a reciprocal wedge-shaped member (not shown) in the first locking member 180. The first locking member 180 is provided with a push-tab 184 to push the wedge-shaped member 186 free of the reciprocal wedge-shaped member in the first locking member 180, and thereby release the insert cassette 150 from the base cassette 110. A similar locking device can be provided on side 120 of the base cassette 110. The locking device can help to hold the insert cassette 150 into position with respect to the base cassette 110 against the force of the lift plate 130.

The paper tray assembly in accordance with an embodiment of the present invention can include a first insert cassette having a first imaging media receptacle sized to receive imaging media of a first size, and a second insert cassette defining a second imaging media receptacle sized to receive imaging media of a second size. The paper tray assembly can also include insert cassettes sized to receive imaging media of other sizes. In this way, a wide variety of sizes of imaging media can be made available to the imaging apparatus, merely by providing insert cassettes each configured to receive imaging media of a different size. Further, the paper tray system can also include plural insert cassettes sized to receive imaging media of the same size so that different types of imaging media, but of the same size, can be provided to the imaging apparatus.

Depending on the configuration of the imaging apparatus in which the base cassette is to be received, the insert cassette can be configured to align the imaging media within the insert cassette for either edge alignment or center alignment, as will now be described in more detail. Turning to FIG. 4, two insert cassettes 150A and 150B are shown in side-by-side plan view. Each insert cassette 150A, 150B is sized and shaped to be received within the insert cassette receptacle 124 of the base cassette 110 of FIG. 3. A first insert cassette 150A has a first imaging media receptacle 158A sized to receive imaging media of a first size (of length L1 and width W1). A second insert cassette 150B has a second imaging media receptacle 158B sized to receive imaging media of a second size (of length L2 and width W1). The first size of imaging media can be, for example, letter-size paper, and the second size of imaging media can be, for example, legal-size paper. The first and second insert cassettes 105A and 150B are each defined by a first edge 153 along the left side of the upper panels (respectively, 156A and 156B). (It is understood that the use of the term "left" is relative to the drawing, and not a restriction on the configuration of the insert cassettes 150A and 150B.) In the configuration depicted in FIG. 4, the first and second imaging media receptacles (158A and 158B, respectively) are each aligned to a common predetermined distance "SD1" from each first edge 153 of the insert cassette (respectively, 158A and 158B). The orientation of the imaging media receptacles 158A and 158B can thus be described as "edge-justified" with respect to an edge of the insert cassette (150A, 150B). An alternative configuration is depicted in FIG. 5, which shows how the imaging media receptacles of two different insert cassettes can be "center-justified" with respect to the insert cassette.

Figure 5:
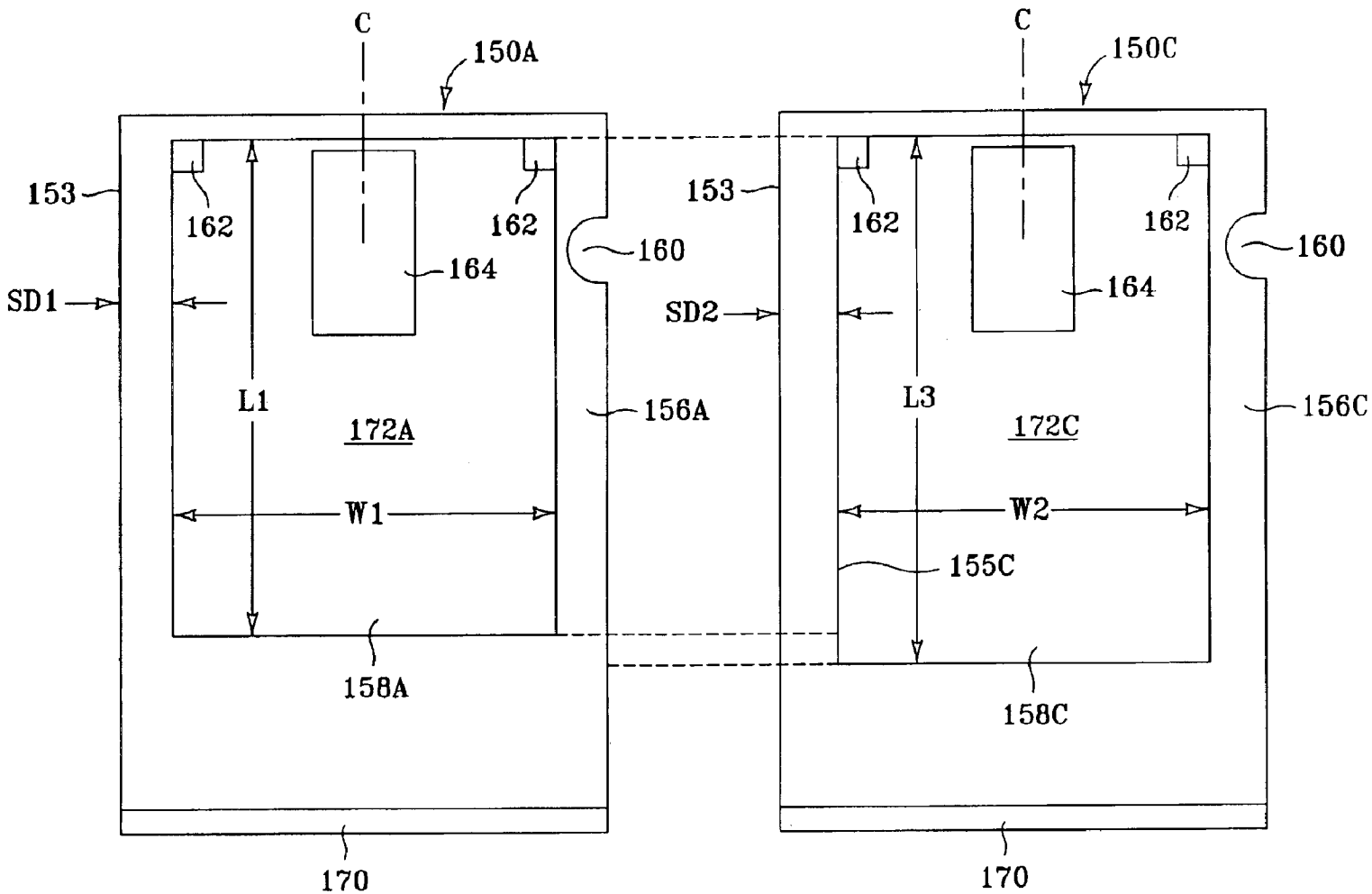
FIG. 5 depicts another plan view of two insert paper trays that can be used in the paper tray assembly of FIG. 3.

Turning to FIG. 5, two insert cassettes 150A (of FIG. 4) and 150C are shown in side-by-side plan view. Each insert cassette 150A, 150C is sized and shaped to be received within the insert cassette receptacle 124 of the base cassette 110 of FIG. 3. As described above, the first insert cassette 150A has a first imaging media receptacle 158A sized to receive imaging media of a first size (of length L1 and width W1). A third insert cassette 150C (insert cassette 150B being the "second insert cassette") has a third imaging media receptacle 158C sized to receive imaging media of a third size (of length L3 and width W2). The third size of imaging media can be, for example, DIN A4 size paper (approximately 8.27 inches by 11.69 inches). The third insert cassette 150C includes a bottom panel 172C which supports imaging media in the receptacle 158C, and a top panel 156C which functions similarly to top panel 156 of FIG. 3 (described above). Each insert cassette 150A, 150C is of the same overall length and width, and the width of each insert cassette is defined by a centerline "C" which bifurcates the width into two equal dimensions. Each media receptacle 158A, 158C is centered with respect to the centerline "C" of the insert cassette (respectively, 150A and 150C). (By "centered with respect to the centerline", it is meant that the centerline is used as the reference line for centering, but not necessarily that the receptacles 158A and 158C are centered about the centerline.) Accordingly, since the width "W2" of receptacle 158C is narrower than the width "W1" of receptacle 158A, the distance "SD2" (measured from the edge 153 of the insert cassette 150C to the edge 155C of the receptacle 158C) will be larger than the similar dimension "SD1" of insert cassette 150A.

As can be seen from FIGS. 4 and 5, the imaging media receptacle (158, FIG. 3) in the insert cassette 150 can be oriented with respect to the base cassette 110 by variably positioning the media receptacle 158 with respect to the upper surface 156 of the insert cassette 150. An alternate method for orienting the imaging media receptacle defined by the insert cassette with respect to the base cassette is to move the insert cassette with respect to the base cassette, rather than moving the media receptacle with respect to the insert cassette. One example of how this can be accomplished is depicted in FIG. 6.

Figure 6:
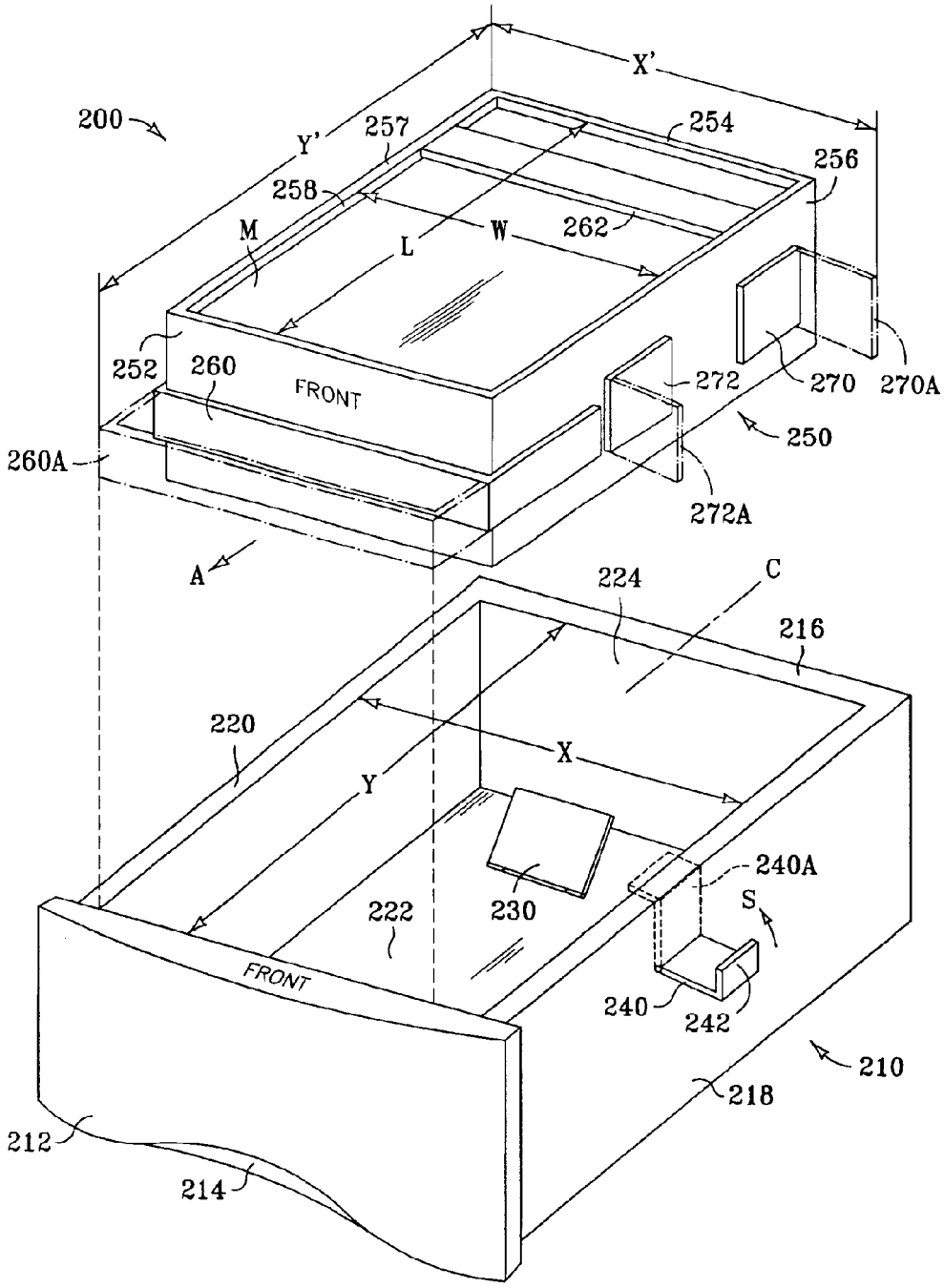
FIG. 6 is an isometric diagram depicting a paper tray assembly in accordance with another embodiment of the present invention.

Turning to FIG. 6, a paper tray assembly 200 to provide imaging media to an imaging apparatus in accordance with a second embodiment of the present invention is depicted in an isometric view. The paper tray assembly comprises a base cassette 210 and an insert cassette 250. The base cassette 210 defines an insert cassette receptacle 224 to receive at least a portion of the insert cassette 250, and the insert cassette 250 defines an imaging media receptacle 258 to receive the imaging media "M". The base cassette 210 has a front panel 212 with a handle 214 to facilitate removal of the tray assembly 200 from the imaging apparatus. The base cassette 210 further includes side panels 218 and 220, bottom panel 222 and rear panel 216, which, together with the front panel 212, define the inset cassette receptacle 224 of dimensions "X" by "Y". The base cassette 210 can further include an imaging media presentation device, such as lift plate 230, which functions similarly to lift plate 130 of FIG. 3 (described above). Similarly, the base cassette 210 can include a locking device 240 to secure the insert cassette 250 in the base cassette 210 against the force of the lift plate 230. In the example shown the locking device 240 is pivotally mounted to side panel 218 of the base cassette 210 and can move in direction "S" to the position indicated by dashed lines as 240A. Tab 242 on the locking device 240 will then be placed over the upper edge of insert cassette side panel 256, holding the insert cassette 250 into the base cassette 210. A second similar locking device can also be provided on the side panel 220 of the base cassette 210.

Figure 7:
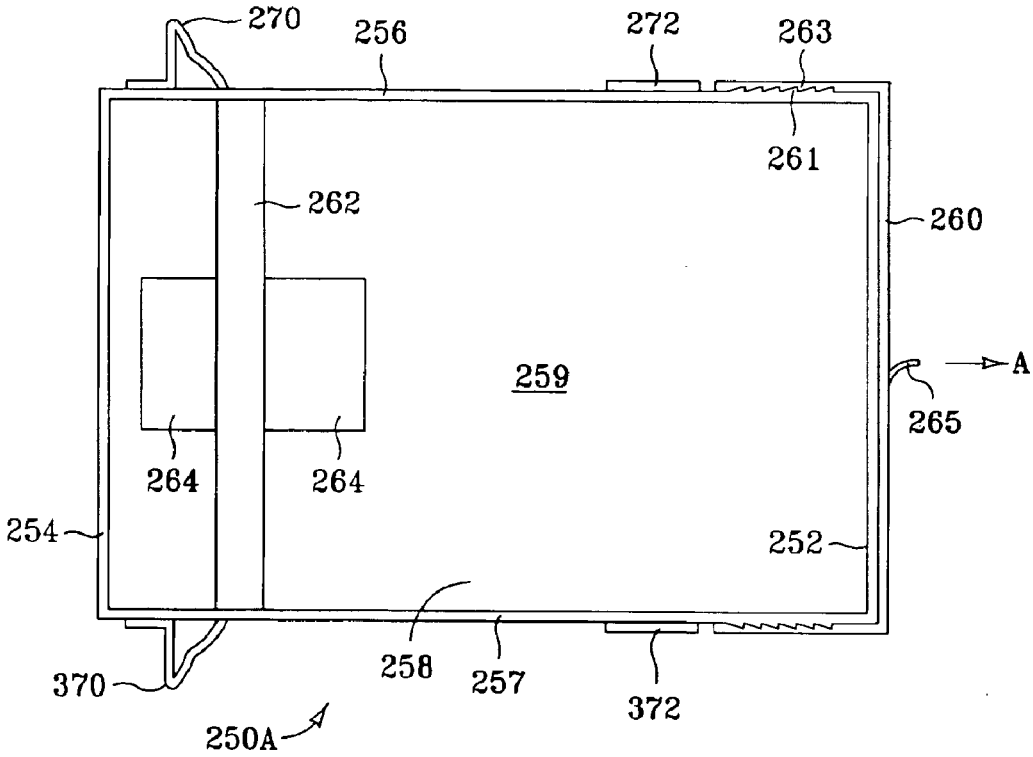
FIG. 7 depicts a plan view of the paper tray insert used in the paper tray assembly of FIG. 6.

The insert cassette 250 includes a front panel 252, rear panel 254, and side panels 256 and 257 which, together with a bottom panel (not seen in this view), define the imaging media receptacle 258 in which imaging media "M" is received. (It is understood that the media "M" is not part of the insert cassette 250, but is only shown for illustrative purposes.) The insert cassette 250 can include an imaging media restraining member 262 which holds the imaging media "M" within the imaging media receptacle 258 against the force of the lift plate 230 when the insert cassette 250 is placed in the insert cassette receptacle 224 of the base cassette 210. The restraining member 262 can also act as a handle member to facilitate removal of the insert cassette 250 from the base cassette 210. The insert cassette 250 can also include one or more separate handle members (not shown) to facilitate removal of the insert cassette 250 from the base cassette 210. Turning briefly to FIG. 7, a plan view of a modified version of the insert cassette 250 is shown as insert cassette 250A. Insert cassette 250A includes a bottom panel 259 which has an opening 264 formed therein to receive the lift-plate 230 (FIG. 6). Returning to FIG. 6, the imaging media "M" received in insert cassette 250 is of dimensions "W" and "L", so that generally the insert cassette 250 is similarly dimensioned, being larger by the thickness of the panels 252, 254, 256 and 257. Dimensions "X" and "Y" of the base cassette 210 are preferably sized to accommodate the largest anticipated imaging media size. For example, if the largest anticipated imaging media size is 8.5 inches wide (dimension "W") by 14 inches long (dimension "L"), and the panels 252, 254, 256 and 257 are each 0.25 inches thick, then dimensions "X" and "Y" will be just slightly larger than 9 inches and 14.5 inches, respectively. The insert cassette 250 is thus sized to be received within the receptacle 224 in the base cassette 210, allowing very little relative movement between the insert cassette and the base cassette, while still allowing the insert cassette to be easily removed from the base cassette. However, when imaging media smaller than 8.5 inches in width, or smaller than 14 inches in length, is to be used in the insert cassette 250, then the insert cassette will not fit snugly within the base cassette, but will tend to move around, since the outside dimensions of the insert cassette 250 will be smaller than the dimensions "X" and "Y" of the insert cassette receptacle 224. Accordingly, one or more spacers can be provided to align the insert cassette 250 within the base cassette 210, as will now be described.

Similar to the discussion above regarding alignment of the imaging media receptacle 158 (FIG. 3) as being alternately aligned to one edge of the insert cassette 150 or to the centerline of the insert cassette, in a similar manner the insert cassette 250 of FIG. 6 can be aligned to one edge of the base cassette 210, or to the centerline "C" of the base cassette. FIG. 6 depicts how one or more spacers can be used to provide side-edge alignment of the insert cassette 250 with the inside edge of base cassette side panel 220. The insert cassette 150 includes two spacers 270 and 272 which can be deployed from a first, retracted position (shown by solid lines) to a second, deployed position (shown by dashed lines as 270A and 272A, respectively). When the spacers 270, 272 are deployed, the insert cassette 250 effectively occupies a width dimension of X', which is preferably slightly less than dimension "X" of receptacle 224 so that the insert cassette 250 does not bind in the receptacle 224. The advantage of configuring the spacers 270 and 272 to be deployable is further described below, but generally allows the insert cassette 250 to only occupy an effective footprint of dimension "W" by "L" when the insert cassette is stored outside of the base cassette 210. Turning briefly to FIG. 7, a plan view of an insert cassette 250A is depicted, similar to insert cassette 250 of FIG. 6 except that insert cassette 250A further comprises spacers 370 and 372 which are attached to the outside surface of side panel 257. Spacers 370 and 372 can be deployable in a manner similar to spacers 270 and 272, as described above. As depicted in FIG. 7, spacers 270 and 370 are deployed, while spacers 272 and 372 are not deployed. When the insert cassette 250A is placed in the base cassette 210 (FIG. 6), then preferably spacers 272 and 372 are also deployed. The use of spacers (270, 272, 370 and 372) on each of the two side panels (256, 257) of the insert cassette 250A allow the insert cassette to be aligned within the base cassette receptacle 224 (FIG. 6) with respect to the base cassette centerline "C".

In addition to the side-to-side alignment of the insert cassette 250 (FIG. 6) in the base cassette 210, the insert cassette can also be aligned in top-to-bottom arrangement (i.e., along dimension "Y"). Generally, the insert cassette 250 will be aligned with respect to a "top" edge of the base cassette 210. The "top" edge of the base cassette 210 is the end of the base cassette 210 which will be located proximate the imaging media feed mechanism when the paper tray assembly 200 is placed in the imaging apparatus (similar to FIG. 2). In FIG. 6, the "top" edge of the base cassette will be the inside surface of the back panel 216. Accordingly, insert cassettes (such as 250) will preferably be aligned within the insert cassette receptacle 224 so that the rear panel 254 of the insert cassette 250 is always flush with the inside surface of the base cassette rear panel 216. Therefore, when an insert cassette 250 is of a shorter length than dimension "Y", a spacer can be used to fit between the inside surface of the base cassette front panel 212, and the outside surface of the insert cassette front panel 252, thus providing top-edge (or "rear-edge") alignment of the insert cassette 250 with respect to the base cassette 210. FIG. 6 depicts an example of a top-edge alignment spacer 260 that can be provided with the insert cassette 250. The spacer 260 is shown in a first, retracted position by solid lines, and in a second, deployed position 260A, indicated by dashed lines. The spacer 260 can be slidably supported by the side panels 256, 257 of the insert cassette. When spacer 260 is deployed, the insert cassette 250 effectively occupies a width dimension of Y', which is preferably slightly less than dimension "Y" of receptacle 224 so that the insert cassette 250 does not bind in the receptacle 224. Both the insert cassette 250 and the base cassette 210 can be marked with indicia, such as the words "FRONT", to facilitate correct positioning of the insert cassette 250 with respect to the insert cassette receptacle 224. Further, an alignment device, such as the alignment device 126, 160 of FIG. 3, can be used to facilitate correct positioning of the insert cassette 250 with respect to the insert cassette receptacle 224.

As can be seen, the use of spacers allows first, second, etc. insert cassettes to be sized precisely to accommodate first, second, etc. sizes of imaging media. That is, the insert cassettes are sized according to the imaging media to be placed in the insert cassette, and not to the size of the opening of the receptacle in the base cassette. Although the spacers can be supported by the base cassette 210, the preferable arrangement is to have each insert cassette support any spacers that are needed to position the insert cassette within the base cassette in a relatively fixed position.

Figure 8:
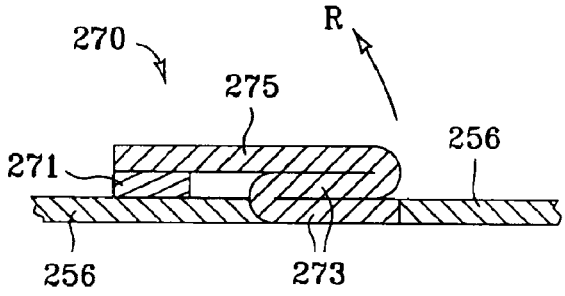
FIG. 8 depicts a detail of a spacing device that can be used with the paper tray insert depicted in FIG. 7.

Turning again to FIG. 7, the front-back alignment spacer 260 can be provided with ratcheting teeth 263 that mate with complementary ratcheting teeth 261 that are supported on the sides 256, 257 of the insert cassette 250A. When the spacer 260 is pulled in direction "A" by a user, the ratcheting teeth 261, 263 will allow the spacer to move to the deployed position, but will resist movement of the spacer 260 back to the non-deployed position. This feature allows the spacer 260 to stay in place when the insert cassette 250A is placed in the base cassette 210 (FIG. 7). A flexible pull-tab 265 can be attached to the front of the spacer 260 to facilitate pulling the spacer out to the deployed position. In a similar manner, the side spacers 270, 272, 370 and 372 can be provided with spacer locks to maintain the spacers in the deployed position after they have been deployed (as depicted by spacers 270 and 370). FIG. 8 shows a plan sectional view of spacer 270, depicting one example of how the spacer can incorporate a spacer lock. In this example the insert cassette side panel 256 can be fabricated (at least partially) from a semi-flexible material, such as solid plastic, stiff cardboard, or corrugated plastic. Spacer 270 includes a foot 271 which secures the spacer body 275 to the side panel 256. A folded brace 273 has a first part which is connected to the side panel 256, and is received within a cut-out in the side panel 256, and a second part which is connected to the spacer main body 275. When the spacer main body 275 is pulled in direction "R", the spacer brace 273 moves to the position depicted in FIG. 7 to thereby hold the spacer body 275 outward from the side panel 256.

Another embodiment of the present invention includes a package of imaging media for use in an imaging apparatus. In this embodiment the imaging apparatus (such as printer 50 of FIG. 2) is provided with a base cassette (such as 110 of FIG. 3 or 210 of FIG. 6) to hold imaging media. Basically, the package of imaging media comprises a rigid imaging media container that is sized to be received within the base cassette, and imaging media placed within the imaging media container. One example of a package of imaging media according to the invention is depicted in FIG. 6, which shows a rigid imaging media container (inset cassette 250) which is sized (in this example, by virtue of spacers 270, 272 and 260) to be received within the base cassette 210. The imaging media container further contains imaging media "M". The imaging media container (such as insert cassette 250 of FIG. 6, or 250A of FIG. 7) can further include one or more spacers (such as spacers 260, 270, 272, 370 and 372 of FIG. 7) which orient the imaging media container 250, 250A with respect to the base cassette 210 (FIG. 6) when the imaging media container is received within the base cassette. Further, the spacers 260, 270, 272, 370 and 372 can be deployable from a first position wherein the spacer is juxtaposed to the imaging media container (as for example spacers 260, 272 and 372 of FIG. 7), to a second position wherein the spacer orients the imaging media container with respect to the base cassette (such as 260A of FIG. 6, and 270, 370 of FIG. 7). In addition, the spacers 260, 270, 272, 370 and 372 can include spacer locking devices (such as ratcheting teeth 261, 263 on spacer 260 of FIG. 7, and brace 273 on spacer 270 of FIG. 8) to secure the spacer in the second (deployed) position.

Figure 9:
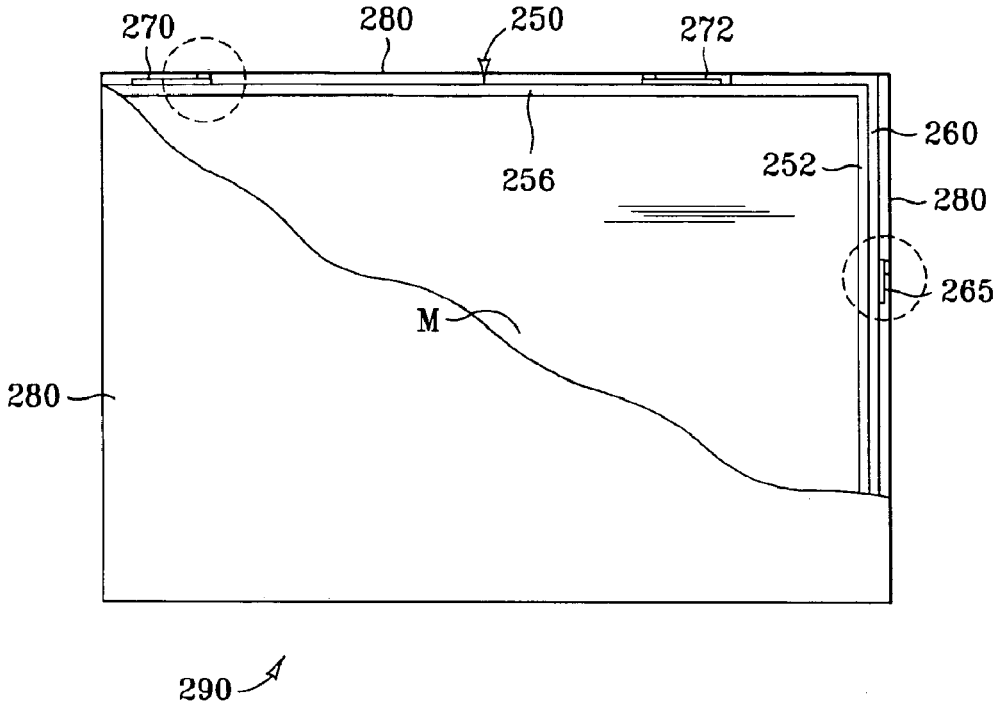
FIG. 9 depicts a plan view of the paper tray insert of FIG. 7, but wrapped in an over-wrap.
Figure 10:
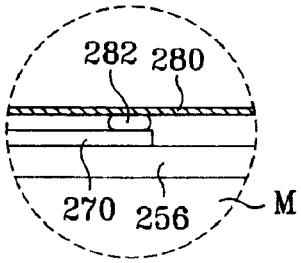
FIG. 10 is a detail of how the over-wrap shown in FIG. 9 can be attached to the spacing device of FIG. 8.
Figure 11:
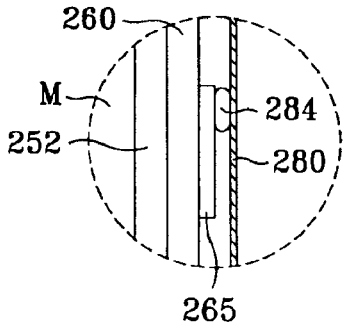
FIG. 11 is a detail of how the over-wrap shown in FIG. 9 can be attached to another spacing device.

Turning to FIG. 9, the package of imaging media 290 can further comprise an over-wrap 280 which covers the imaging media container 250. In FIG. 9 the over-wrap is shown in a partial broken view to allow the imaging media container 250 to be seen. Preferably, the over-wrap 280 is attached to one or more of the spacers 270, 272, 260 to cause the spacer to which it is attached to deploy, or partially deploy, to the second (deployed) position when the over-wrap 280 is removed from the imaging media container 250. For example, turning to the detail diagram depicted in FIG. 11, a spot of glue 284 can be placed between the over-wrap 280 and the pull-tab 265 so that when the over-wrap is removed, the pull-tab is pulled out to the position depicted in FIG. 7. From this position the pull-tab 265 can easily be pulled in direction "A" by a user to deploy the spacer 260 to the position depicted by 260A in FIG. 6. Likewise, turning to the detail diagram depicted in FIG. 10, a spot of glue 282 can be placed between the over-wrap 280 and the spacer 270 so that when the over-wrap is removed, the spacer is at least partially pulled out to the position depicted in FIG. 7.

In addition to the features described above, the imaging media container 250 of the package of imaging media 290 can include other features described above with respect to insert cassettes 250 (FIG. 6) and 250A (FIG. 7), such as the imaging media restraining member 262 (FIG. 7) and the bottom panel 259 having the opening 264 for receiving a lift plate 230 in the base cassette 210 (see FIG. 6).

In this way a manufacturer of imaging media can provide a user with imaging media that is pre-packaged in an insert cassette for use in the paper tray system of the present invention. This removes the need for handling typically required by a user in removing the imaging media from the shipping package and placing the imaging media into the paper tray. Further, it provides a convenient storage receptacle for the imaging media when the imaging media is not being used in an imaging apparatus. The imaging media container 250 can preferably be manufactured from a recyclable material, such as plastic or cardboard, to reduce waste.

While the present invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A paper tray to provide imaging media to an imaging apparatus, comprising:

a base cassette configured to be received by the imaging apparatus;

a first insert cassette configured to be received within the base cassette, wherein a first imaging media receptacle is defined by a top opening in the first insert cassette, and wherein the first imaging media receptacle is sized to contain imaging media of a first size;

a second insert cassette defining a second imaging media receptacle, and wherein the second imaging media receptacle is sized to contain imaging media of a second size; and wherein each of the first and second insert cassettes is defined by a first edge, and the first and second imaging media receptacles are each aligned to a common predetermined distance from each first edge.

2. The paper tray of claim 1, and wherein the base cassette comprises a first keying member, and wherein at least one of the first and second insert cassettes comprises a second keying member configured to mate with the first keying member.

3. The paper tray of claim 1, and wherein at least one of the first and second insert cassettes comprises a handle member to facilitate removal of the insert cassette from the base cassette.

4. The paper tray of claim 1, and wherein:

the base cassette comprises a first bottom panel, a lift plate, and a biasing member to bias the lift plate away from the first bottom panel; and each of the first and second insert cassettes comprises a second bottom panel defining an opening therein to allow the lift plate to contact imaging media contained within the insert cassette.

5. The paper tray of claim 4, and wherein at least one of the first and second insert cassettes further comprises a restraining member to restrain imaging media received within the insert cassette from being ejected by the lift plate.

6. The paper tray of claim 5, and wherein:

the base cassette further comprises a first locking member; and at least one of the first and second insert cassettes comprises a second locking member configured to engage the first locking member and thereby hold the insert cassette in relatively fixed position with respect to the base cassette.

7. The paper tray of claim 1, and wherein:

the base cassette comprises a front panel, a back panel, and two side panels adjoining the front and back panels, the front, back and side panels forming an upper periphery which defines a receptacle to receive one of each of the first and second insert cassettes; and each of the first and second insert cassettes comprises a top panel which is supported by the base cassette upper periphery when the respective insert cassette is placed in the base cassette receptacle.

8. The paper tray of claim 1, and wherein the base cassette comprises a front panel, a back panel, two side panels adjoining the front and back panels, and a bottom panel, the front, back, side and bottom panels defining a receptacle to receive one of each of the first and second insert cassettes, and wherein each of the first and second insert cassettes is supported by the bottom panel when the insert cassette is placed in the base cassette receptacle.

9. The paper tray of claim 1, and wherein:

each of the first and second insert cassettes are of the same width, and the width is defined by a centerline; and each of the first and second imaging media receptacles are centered about the respective centerlines of the first and second insert cassettes.

10. A paper tray assembly to provide imaging media to an imaging apparatus, comprising:

first and second insert cassettes respectively defining first and second imaging media receptacles, wherein the first and second imaging media receptacles are sized to receive imaging media of a first size and a second size respectively, and wherein the first and second imaging media receptacles are defined by a top opening in the respective insert cassette; and a base cassette defining an insert cassette receptacle to receive at least a portion of one of each of the first and second insert cassettes, wherein the first and second insert cassettes are configured to be received within the insert cassette receptacle so as to be aligned with the base cassette, and wherein the second insert cassette comprises a spacer to align the second insert cassette with the base cassette.

11. The paper tray assembly of claim 10, and wherein the spacer is deployable from a first position to a second position.

12. The paper tray assembly of claim 10, and wherein the base cassette is defined by a centerline, and wherein the first and second insert cassettes are configured to be received within the insert cassette receptacle so as to be aligned with the base cassette centerline.

13. The paper tray assembly of claim 12, and wherein the second insert cassette comprises a plurality of spacers to align the second insert cassette with the base cassette centerline.

14. The paper tray assembly of claim 13, and wherein each of the plurality of spacers is deployable from a first position to a second position.

15. The paper tray assembly of claim 10, and wherein the base cassette is defined by a top edge, and wherein the first and second insert cassettes are configured to be received within the insert cassette receptacle so as to be aligned with the base cassette top edge.

16. The paper tray assembly of claim 15, and wherein the second insert cassette comprises a spacer to align the second insert cassette with the base cassette top edge.

17. The paper tray assembly of claim 16, and wherein the spacer is deployable from a first position to a second position.

* * * * *